United States Patent [19]

Nomura et al.

[11] Patent Number: 4,915,900

[45] Date of Patent: Apr. 10, 1990

[54] FREE-CUTTING STEEL HAVING HIGH FATIGUE STRENGTH

[75] Inventors: Itie Nomura; Takao Ooki; Yoshihiro Wakikado, all of Aichi, Japan

[73] Assignees: Aichi Steel Works, Ltd., Tokai; Toyota Jidosha Kabushiki Kaisha, Toyota, both of Japan

[21] Appl. No.: 257,922

[22] Filed: Oct. 14, 1988

[30] Foreign Application Priority Data

Oct. 15, 1987 [JP] Japan ..... 62-260330

[51] Int. Cl.[4] ..... C22C 38/60; C22C 38/12

[52] U.S. Cl. ..... 420/84; 420/87

[58] Field of Search ..... 420/84, 87

[56] References Cited

U.S. PATENT DOCUMENTS

| | | | |
|---|---|---|---|
| 3,876,422 | 4/1975 | Cantera et al. | 420/84 |
| 4,265,660 | 5/1981 | Giflo | 420/84 |

FOREIGN PATENT DOCUMENTS

| | | | |
|---|---|---|---|
| 2451403 | 10/1980 | France . | |
| 55-138056 | 10/1980 | Japan | 420/87 |
| 59-16948 | 1/1984 | Japan | 420/84 |

*Primary Examiner*—Deborah Yee

*Attorney, Agent, or Firm*—Oblon, Spivak, McClelland, Maier & Neustadt

[57] ABSTRACT

A free-cutting steel having a high fatigue strength which consists essentially of 0.30–0.50% C, 0.10–0.50% Si, 0.50–1.00% Mn, 0.04–0.12% S, 0.005–0.20% V, 0.005–0.018% Al, 0.05–0.30% Pb, and 0.001–0.006% Ca by weight, and as the remainder, Fe and inevitable impurities. It may additionally contain 0.50% or less of Cr.

3 Claims, No Drawings

FREE-CUTTING STEEL HAVING HIGH FATIGUE STRENGTH

BACKGROUND OF THE INVENTION

1. Field of the Invention:

The present invention relates to a free-cutting steel having a high fatigue strength and outstanding machinability, which is suitable for use as mechanical structural parts such as crank-shafts, connecting rods, and axle shafts of automotive engines. 2. Description of the Prior Art:

Heretofore, mechanical structural parts such as crank-shafts of automotive engines have usually been made of structural carbon steel, such as S50C, or a steel containing such elements as S and Pb which improve machinability, by hot forging, hardening (quenching), and tempering. They are required to have a high fatigue strength because they are subject to damage resulting from fatigue failure.

One possible way to improve the fatigue strength of steels is to increase the hardness of steels. The increased hardness, however, decreases the machinability of steels. Machinability can be improved by the addition of such elements as S and Pb; but they lead to notches which lower the fatigue strength. Thus, fatigue strength machinability are mutually contradictory characteristics. The present invention was completed to address this problem.

SUMMARY OF THE INVENTION

It is an object of the present invention to provide a free-cutting steel which is superior in both fatigue strength and machinability.

The first aspect of the present invention is concerned with a free-cutting steel having a high fatigue strength which consist essentially of 0.30–0.50% C., 0.10–0.50% Si, 0.50–1.00% Mn, 0.04–0.12% S, 0.05–0.20% V, 0.005–0.018% Al, 0.05–0.30% Pb, and 0.001–0.006% Ca, and as the remainder, Fe and inevitable impurities (by weight).

The second aspect of the present invention is concerned with a free-cutting steel having a high fatigue strength which is formed by adding a specific amount of Cr to the free-cutting steel of the first aspect of the present invention. In other words, it consist essentially of 0.30–0.50% C, 0.10–0.50% Si, 0.50–1.00% Mn, 0.04–0.12% S, 0.05–0.20% V, 0.005–0.018% Al, 0.05–0.30% Pb, 0.001–0.006% Ca, and 0.50% or less Cr, and as the remainder, Fe and inevitable impurities (by weight).

DETAILED DESCRIPTION OF THE INVENTION

The free-cutting steel pertaining to the present invention is based on structural carbon steel, and it is incorporated with S, Pb, and Ca in combination to improve machinability and also with a controlled amount of V and Cr.

The elements S and Pb are present in the free-cutting steel in the form of MnS and simple substance, respectively. They improve the disposal of chips in turning and drilling. The element Ca increases the tool life in turning. These elements, however, would cause "notches" which start fatigue failure and hence lower fatigue strength, if they are simply added. The present inventors carried out a series of researches on how to avoid the notch effect caused by these elements. As the result, it was found that the notch effect can be eliminated if the composite inclusion (MnS-Pb-Ca) of these elements is covered with highly ductile ferrite. This is accomplished by cooling the free-cutting steel of the present invention at a specific cooling rate, instead of conventional hardening and tempering, after hot forging. This cooling causes fine ferrite crystals to precipitate around the inclusion in the course of transformation from the austenite structure to the ferrite-pearlite structure.

Conventional carbon steel such as S50C for mechanical structures has a coarse ferrite-pearlite microstructure after hot forging with no post-heat treatment. Therefore, it has a lower strength and fatigue strength than the material which has undergone hardening and tempering. The carbon steel, however, can have an increased strength and fatigue strength if it is incorporated with V. The carbon steel can also have a fine ferrite-pearlite microstructure after hot forging with no post-heat treatment, if ferrite is precipitated around the composite inclusion. Thus, the carbon steel can have a fatigue strength which is equal to or higher than that of the material which has undergone hardening and tempering. In addition, the steel having the ferrite-pearlite structure which has not undergone hardening and tempering after hot forging is superior in machinability to the one which has undergone hardening and tempering after hot forging.

The following is the reason why the amount of each element is specified as mentioned above.

Carbon should be comprised at least 0.30% to provide the free-cutting steel with a sufficient strength required for use as structural steel. The upper limit is set at 0.50% because excess carbon decreases the amount of ferrite to prevent the precipitation of ferrite around the composite inclusion, and leads to a decrease in toughness of the free-cutting steel.

Silicon should be comprised at least 0.10% to function as a deoxidizer. The upper limit is set at 0.50% because excess silicon decreases the toughness of the free-cutting steel.

Manganese should be comprised at least 0.50% to form MnS and ferrite-pearlite structure. The upper limit is set at 1.00% because excess manganese impairs the machinability of the free-cutting steel.

Sulfur should be comprised at least 0.04% to form MnS which is necessary for the improved machinability as mentioned above and also functions as nuclei for ferrite precipitation. The upper limit is set at 0.12% because excess sulfur impairs the hot working performance of the free-cutting steel.

Vanadium should be comprised at least 0.05% to precipitate in the form of carbide in the ferrite structure while the free-cutting steel is being cooled after forging, thereby increasing the strength. The upper limit is set at 0.20% because excess vanadium does not produce any effect in proportion to the excess amount but increases the production cost.

Aluminum should be comprised at least 0.005% to function as a deoxidizer. The upper limit is set at 0.018% because excess aluminum forms $Al_2O_3$ which impairs the machinability and especially shortens the tool life.

Lead should be comprised at least 0.05% to improve the machinability. The upper limit is set at 0.30% because excess lead does not produce any effect in proportion to the excess amount but increases the production cost.

Calcium should be comprised at least 0.001% to cover the surface of the cutting tool, thereby increasing the tool life, and makes the shape of MnS round, thereby preventing the occurrence of notches. The upper limit is set at 0.006% because its effect levels off beyond the upper limit.

In the second aspect of the invention, the free-cutting steel is incorporated with chromium in addition to the above-mentioned elements in order to increase the strength further. The upper limit of the chromium content is set at 0.50% because excess chromium impairs the machinability.

The amounts of carbon and manganese should be such that the C/Mn ratio is not less than 0.5. With a larger amount of manganese relative to the amount of carbon, the free-cutting steel improves in hardening performance, making it difficult for ferrite to precipitate around the above-mentioned inclusions.

The free-cutting steels according to the first and second aspects of the present invention exhibit their outstanding fatigue strength and machinability when they are cooled at a rate of 1° C. to 100° C. per minute from 800° C. to 600° C. after hot forging. This cooling causes ferrite to precipitate around the MnS-Pb-Ca composite inclusions, forming a fine ferrite-pearlite structure.

According to the first aspect of the present invention, the free-cutting steel is incorporated with sulfur, lead, and calcium so that composite inclusions of MnS-Pb-Ca are formed to improve the machinability and the inclusions are covered with highly ductile ferrite. The covering of inclusions with ductile ferrite eliminates the notch effect which lowers the fatigue strength. The amount and ratio of these three components and other components are controlled as mentioned above, so that the free-cutting steel has outstanding strength and fatigue strength as well as machinability. The free-cutting steel according to the first aspect of the present invention is of practical value when used for hot-forged parts such as crank-shafts.

According to the second aspect of the present invention, the free-cutting steel pertaining to the first aspect of the invention is further incorporated with chromium. It exhibits outstanding strength much more in addition to the above-mentioned superior characteristic properties.

The invention will be described with reference to the following examples and comparative examples.

EXAMPLE 1

Fifteen kinds of steels, each having the composition as shown in Table 1, were prepared. Samples A to D represent the steels pertaining to the first aspect of the present invention; samples E and F represent the steels pertaining to the second aspect of the present invention; samples G to M represent the steels in comparative examples; and samples N and 0 represent the steels of conventional type. Samples A to M did not undergo hardening and tempering after forging, and samples N and 0 underwent hardening and tempering after forging. In Table 1, blank columns for Cr denote not more than 0.2% of chromium as impurities.

Samples A to M were prepared as follows: At first, the steel was cast into a 300-kg ingot by means of a high-frequency melting furnace. The ingot was extended by forging into a rod 100 mm in diameter. After heating to 1250° C., the rod was further extended by forging at 1200–1100° C. into a rod 65 mm in diameter. The rod was air-cooled at a cooling rate of 25° C./min. For samples N and O, the forged rod was oil-hardened at 880° C. and tempered at 530° C.

The steel samples prepared as mentioned above were evaluated for their performance. The results are shown in Table 2.

TABLE 1

| Sample | Composition (wt %) | | | | | | | | |
|---|---|---|---|---|---|---|---|---|---|
| | C | Si | Mn | S | Cr | V | Al | Pb | Ca |
| A | 0.45 | 0.25 | 0.86 | 0.052 | — | 0.11 | 0.010 | 0.21 | 0.0024 |
| B | 0.48 | 0.35 | 0.68 | 0.044 | — | 0.07 | 0.008 | 0.25 | 0.0035 |
| C | 0.40 | 0.13 | 0.72 | 0.062 | — | 0.12 | 0.010 | 0.16 | 0.0046 |
| D | 0.38 | 0.47 | 0.52 | 0.057 | — | 0.09 | 0.006 | 0.12 | 0.0012 |
| E | 0.32 | 0.32 | 0.57 | 0.081 | 0.35 | 0.18 | 0.011 | 0.08 | 0.0015 |
| F | 0.43 | 0.41 | 0.84 | 0.068 | 0.46 | 0.16 | 0.018 | 0.19 | 0.0031 |
| G | 0.44 | 0.23 | 0.80 | 0.025 | — | 0.12 | 0.015 | 0.23 | 0.0030 |
| H | 0.45 | 0.23 | 0.86 | 0.056 | — | 0.10 | 0.012 | — | 0.0028 |
| I | 0.46 | 0.20 | 0.82 | 0.049 | — | 0.10 | 0.013 | 0.25 | — |
| J | 0.55 | 0.21 | 0.81 | 0.049 | — | 0.09 | 0.013 | 0.19 | 0.0040 |
| K | 0.42 | 0.28 | 1.02 | 0.072 | — | — | 0.008 | 0.20 | 0.0033 |
| L | 0.45 | 0.28 | 0.77 | 0.065 | — | 0.13 | 0.021 | 0.31 | 0.0029 |
| M | 0.45 | 0.40 | 1.20 | 0.042 | — | 0.09 | 0.012 | 0.18 | 0.0030 |
| N | 0.49 | 0.23 | 0.70 | 0.018 | — | — | 0.032 | — | — |
| O | 0.50 | 0.21 | 0.72 | 0.058 | — | — | 0.015 | 0.30 | 0.0035 |

Samples A to F: working examples, as forged.
Samples G to M: comparative examples, as forged.
Samples N and O: conventional steels, with hardening and tempering.

TABLE 2

| Sample | Performance | | | | | | |
|---|---|---|---|---|---|---|---|
| | Hardness (Hv) | Fatigue limit (kgf/mm$^2$) | Tensile strength (kgf/mm$^2$) | Endurance ratio | Turning machinability (min) | Drilling machinability (m) | Microstructure |
| A | 247 | 41.0 | 82.0 | 0.500 | 165 | 12.3 | Fine F.P |
| B | 236 | 38.3 | 78.9 | 0.485 | 230 | 17.5 | Fine F.P |
| C | 220 | 36.7 | 73.3 | 0.501 | 300 | 23.0 | Fine F.P |
| D | 212 | 34.4 | 71.0 | 0.485 | 390 | 31.0 | Fine F.P |
| E | 220 | 36.2 | 73.5 | 0.493 | 320 | 25.0 | Fine F.P |
| F | 268 | 43.8 | 89.3 | 0.490 | 123 | 10.2 | Fine F.P |
| G | 241 | 36.0 | 80.0 | 0.450 | 13 | 7.5 | Coarse F.P |
| H | 243 | 39.1 | 81.5 | 0.480 | 33 | 8.1 | Fine F.P |
| I | 242 | 38.8 | 80.8 | 0.480 | 8 | 7.5 | Fine F.P |
| J | 264 | 38.7 | 88.0 | 0.440 | 90 | 3.5 | Coarse F.P |
| K | 215 | 30.0 | 71.5 | 0.420 | 340 | 28.1 | Fine F.P |
| L | 244 | 39.4 | 81.3 | 0.485 | 5 | 9.2 | Fine F.P |
| M | 266 | 38.3 | 88.8 | 0.431 | 95 | 3.3 | Coarse F.P |
| N | 250 | 39.6 | 83.7 | 0.473 | 0.8 | 1.8 | Incomplete |
| O | 248 | 36.0 | 83.0 | 0.434 | 25 | 7.0 | Incomplete |

The evaluation test was carried out in the following manner. Tensile strength was measured using test pieces conforming to JIS No. 4. Hardness was measured at the chucking part of the test piece. Fatigue properties were measured using a smooth test piece having a parallel part 8 mm in diameter on an Ono rotary bending fatigue tester. Fatigue limit represents the value measured after $10^7$ cycles. Endurance is given by the ratio of fatigue limit to tensile strength. Turning machinability is expressed in terms of time (minutes) required for the flank of a TiN-coated carbide-tipped tool to wear 0.2 mm when the test piece is cut at a feed speed of 0.20 mm/rev., depth of cut of 2.0 mm, and cutting speed of 200 m/min, without lubrication. Drilling machinability is expressed in terms of the drilling distance (meter) a straight drill (SKH9, 6 mm in diameter) achieves until it becomes completely dull and worn when the test piece is drilled at a feed speed of 0.11 mm/rev. and 800 rpm, without lubrication. Incidentally, "Fine F.P" and "Coarse F.P" in the column of microstructure stand for fine ferrite-pearlite structure and coarse ferrite-pearlite structure, respectively. "Incomplete" means the incomplete hardened and tempered structure.

It is noted from Tables 1 and 2 that the free-cutting steel pertaining to the present invention has a hardness (Hv) not less than 210, a fatigue limit not less than 33 kgf/mm$^2$, (after $10^7$ cycles), a tensile strength not less than 70 kgf/mm$^2$, and an endurance ratio not less than 0.47. In addition, it has good machinability, that is, 40 minutes for turning machinability and 5 meters for drilling machinability. It is also noted that the microstructure of the free-cutting steel is composed of fine ferrite-pearlite crystals.

Comparative sample G (containing as little sulfur as impurity), comparative sample H (containing no lead), and comparative sample I (containing no calcium) are poor in turning machinability. Comparative sample J (with a high carbon content) and comparative sample M (with a high manganese content) are poor in drilling machinability. Comparative sample K (containing no vanadium) is superior in turning machinability but has a low fatigue strength and endurance ratio. Comparative sample L (with a high aluminum content) is extremely poor in turning machinability.

By contrast, conventional steel sample N, which underwent hardening and tempering after forging, has a high fatigue strength and endurance ratio but is poor in machinability due to lack of lead and calcium which contribute to the free-cutting performance. Conventional steel sample 0 containing no vanadium, which underwent hardening and tempering after forging, has a low endurance ratio due to the notch effect. This suggests that the desired machinability is not obtained by adding lead and calcium alone.

EXAMPLE 2

Four test pieces were prepared from a free-cutting steel of the same composition as Sample A in Example 1, by cooling under different conditions after forging. They were evaluated in the same manner as in Example 1. The cooling conditions are shown in Table 3, and the results of evaluation are shown in Table 4.

It is noted from Tables 3 and 4 that sample A2 (which was cooled at a cooling rate of 80° C./min) and sample A3 (which was cooled at a cooling rate of 5° C./min) have a high fatigue strength and outstanding machinability. This suggests that a broad range of cooling rate is permissible. By contrast, sample Al (which was cooled at a rate of 130° C./min) is poor in drilling machinability and endurance due to high hardness, the absence of ferrite around composite inclusions, and coarse ferrite-pearlite structure. Sample A4 (which was cooled slowly at a cooling rate of 0.8° C./min) has a low hardness and fatigue strength. These results suggest that the desired cooling rate is 1 to 100° C./min.

TABLE 3

| | Cooling Conditions | |
|---|---|---|
| Sample | Cooling rate (°C./min) | Cooling atmosphere |
| A1 | 130 | Mist cooling |
| A2 | 80 | Fan cooling |
| A3 | 5 | Slow cooling in straw ash |
| A4 | 0.8 | Slow cooling in heat insulating material |

TABLE 4

| | Performance | | | | | | |
|---|---|---|---|---|---|---|---|
| Sample | Hardness (Hv) | Fatigue limit (kgf/mm$^2$) | Tensile strength (kgf/mm$^2$) | Endurance ratio | Turning machinability (min) | Drilling machinability (m) | Microstructure |
| A1 | 293 | 44.0 | 97.7 | 0.450 | 45 | 2.1 | Coarse F.P |
| A2 | 275 | 46.0 | 91.0 | 0.505 | 80 | 5.0 | Fine F.P |
| A3 | 212 | 35.1 | 70.5 | 0.498 | 380 | 24.0 | Fine F.P |
| A4 | 170 | 25.1 | 57.1 | 0.440 | ≧400 | ≧40 | Fine F.P |

What is claimed is:

1. A free-cutting steel having a high fatigue strength consisting essentially of 0.30–0.50% C., 0.10–0.50% Si, 0.50–1.00% Mn, 0.04–0.12% S, 0.05–0.20% V, 0.005–0.018% Al, 0.05–0.30% Pb, and 0.001–0.006% Ca by weight, the remainder being Fe and inevitable impurities.

2. A free-cutting steel having a high fatigue strength consisting essentially of 0.30–0.50% C, 0.10–0.50% Si, 0.50–1.00% Mn, 0.04–0.12% S, 0.05–0.20% V, 0.005–0.018% Al, 0.05–0.30% Pb, 0.001–0.006% Ca, and 0.50% or less Cr by weight, the remainder being Fe and inevitable impurities.

3. A free-cutting steel according to claim 1, wherein the Al content is 0.005–0.012% by weight.

* * * * *